US005833333A

United States Patent [19]

Brown

[11] Patent Number: 5,833,333

[45] Date of Patent: Nov. 10, 1998

[54] COMBINATION BOX AND STOOL

[76] Inventor: Leon G. Brown, 121 Cricklade Avenue, Streatham, London, England, SW2 3HF

[21] Appl. No.: 985,408

[22] Filed: Dec. 4, 1997

[51] Int. Cl.[6] ..... A47B 83/00

[52] U.S. Cl. ..... 312/235.1; 312/235.2; 109/12 A

[58] Field of Search ..... 312/235.1, 235.2, 312/235.3, 237, 240, 244, 257.1; 190/1, 8, 12 A; 220/23.86, 23.4, 23.6; 108/11, 14

[56] References Cited

U.S. PATENT DOCUMENTS

| | | | |
|---|---|---|---|
| D. 347,113 | 5/1994 | Bornhorst et al. | D3/272 |
| 2,564,338 | 8/1951 | McCarroll | 312/235.2 X |
| 2,628,659 | 2/1953 | Carpenter | 190/8 |
| 3,908,852 | 9/1975 | Ricobene et al. | 220/23.6 X |
| 4,067,607 | 1/1978 | Battles | 312/202 |
| 4,195,889 | 4/1980 | Coyne | 312/240 |
| 4,581,902 | 4/1986 | Starck et al. | 312/241 |
| 4,744,613 | 5/1988 | Brantingham et al. | 312/237 |
| 5,437,502 | 8/1995 | Warnick et al. | 312/244 |

FOREIGN PATENT DOCUMENTS

| | | | |
|---|---|---|---|
| 281151 | 12/1927 | United Kingdom | 190/12 A |
| 1227808 | 4/1971 | United Kingdom | 312/235.1 |
| 2264227 | 8/1993 | United Kingdom | 312/235.3 |

*Primary Examiner*—Peter M. Cuomo
*Assistant Examiner*—James O. Hansen

[57] ABSTRACT

A new combination box and stool for providing a container with a lid that may be used as a stool and support stand. The inventive device includes a bottom container with front, back, and side walls upwardly extending from a bottom wall to define a bottom container hollow interior. When the invention is in an assembled condition a top lid rests on the bottom container top edge to cover the bottom container hollow interior. The top lid has a pair of spaced apart legs downwardly extending from the top lid lower surface. When in the assembled condition, each leg is inserted into a respective leg slot. A locking means is included for locking the top lid to the bottom container when positioned in the assembled condition. When the top lid and the bottom container are not in the assembled condition, the legs are restable on a surface and the bottom container bottom wall is restable on the top lid upper surface.

9 Claims, 2 Drawing Sheets

COMBINATION BOX AND STOOL

BACKGROUND OF THE INVENTION

1. Field of the Invention

The present invention relates to storage containers and more particularly pertains to a new combination box and stool for providing a container with a lid that may be used as a stool and support stand.

2. Description of the Prior Art

The use of storage containers is known in the prior art. More specifically, storage containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art storage containers include U.S. Pat. No. 4,067,607; U.S. Pat. No. 5,437,502; U.S. Pat. No. 4,581,902; U.S. Pat. No. 4,195,889; U.S. Pat. No. 4,744,613; and U.S. Pat. No. Des. 347,113.

While these devices fulfill their respective, particular objectives and requirements, the aforementioned patents do not disclose a new combination box and stool. The inventive device includes a bottom container with front, back, and side walls upwardly extending from a bottom wall to define a bottom container hollow interior. When the invention is in an assembled condition a top lid rests on the bottom container top edge to cover the bottom container hollow interior. The top lid has a pair of spaced apart legs downwardly extending from the top lid lower surface. When in the assembled condition, each leg is inserted into a respective leg slot. A locking means is included for locking the top lid to the bottom container when positioned in the assembled condition. When the top lid and the bottom container are not in the assembled condition, the legs are restable on a surface and the bottom container bottom wall is restable on the top lid upper surface.

In these respects, the combination box and stool according to the present invention substantially departs from the conventional concepts and designs of the prior art, and in so doing provides an apparatus primarily developed for the purpose of providing a container with a lid that may be used as a stool and support stand.

SUMMARY OF THE INVENTION

In view of the foregoing disadvantages inherent in the known types of storage containers now present in the prior art, the present invention provides a new combination box and stool construction wherein the same can be utilized for providing a container with a lid that may be used as a stool and support stand.

The general purpose of the present invention, which will be described subsequently in greater detail, is to provide a new combination box and stool apparatus and method which has many of the advantages of the storage containers mentioned heretofore and many novel features that result in a new combination box and stool which is not anticipated, rendered obvious, suggested, or even implied by any of the prior art storage containers, either alone or in any combination thereof.

To attain this, the present invention generally comprises a bottom container with front, back, and side walls upwardly extending from a bottom wall to define a bottom container hollow interior. When the invention is in an assembled condition a top lid rests on the bottom container top edge to cover the bottom container hollow interior. The top lid has a pair of spaced apart legs downwardly extending from the top lid lower surface. When in the assembled condition, each leg is inserted into a respective leg slot. A locking means is included for locking the top lid to the bottom container when positioned in the assembled condition. When the top lid and the bottom container are not in the assembled condition, the legs are restable on a surface and the bottom container bottom wall is restable on the top lid upper surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination box and stool apparatus and method which has many of the advantages of the storage containers mentioned heretofore and many novel features that result in a new combination box and stool which is not anticipated, rendered obvious, suggested, or even implied by any of the prior art storage containers, either alone or in any combination thereof.

It is another object of the present invention to provide a new combination box and stool which may be easily and efficiently manufactured and marketed.

It is a further object of the present invention to provide a new combination box and stool which is of a durable and reliable construction.

An even further object of the present invention is to provide a new combination box and stool which is susceptible of a low cost of manufacture with regard to both materials and labor, and which accordingly is then susceptible of low prices of sale to the consuming public, thereby making such combination box and stool economically available to the buying public.

Still yet another object of the present invention is to provide a new combination box and stool which provides in the apparatuses and methods of the prior art some of the advantages thereof, while simultaneously overcoming some of the disadvantages normally associated therewith.

Still another object of the present invention is to provide a new combination box and stool for providing a container with a lid that may be used as a stool and support stand.

Yet another object of the present invention is to provide a new combination box and stool which includes a bottom container with front, back, and side walls upwardly extending from a bottom wall to define a bottom container hollow interior. When the invention is in an assembled condition a top lid rests on the bottom container top edge to cover the bottom container hollow interior. The top lid has a pair of spaced apart legs downwardly extending from the top lid lower surface. When in the assembled condition, each leg is inserted into a respective leg slot. A locking means is included for locking the top lid to the bottom container when positioned in the assembled condition. When the top lid and the bottom container are not in the assembled condition, the legs are restable on a surface and the bottom container bottom wall is restable on the top lid upper surface.

Still yet another object of the present invention is to provide a new combination box and stool that can be used to conveniently store records and compact discs, clothes, tools, and toys.

Even still another object of the present invention is to provide a new combination box and stool that allows the top lid to be used as a stool, a stand, or a table.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
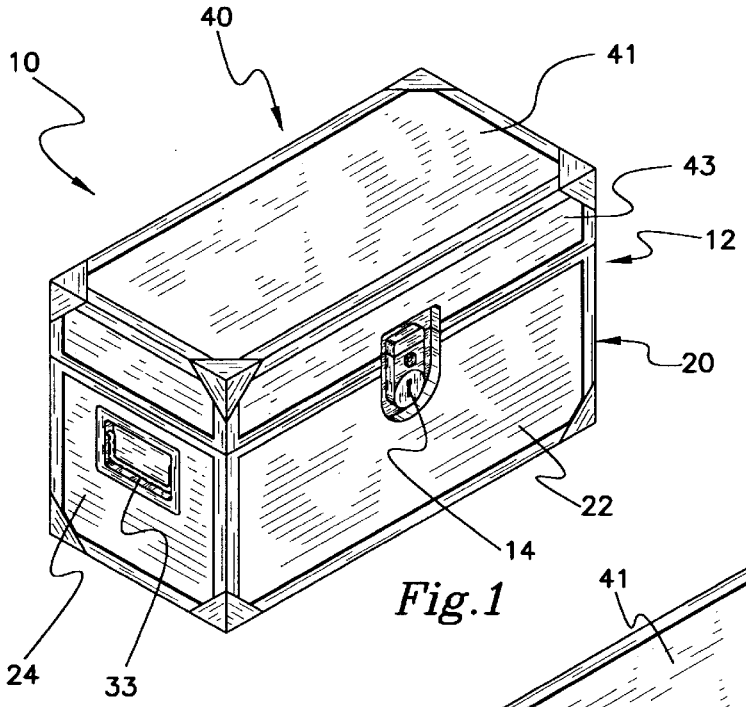
FIG. 1 is a schematic perspective view of a new combination box and stool in the assembled condition according to the present invention.
Figure 2:
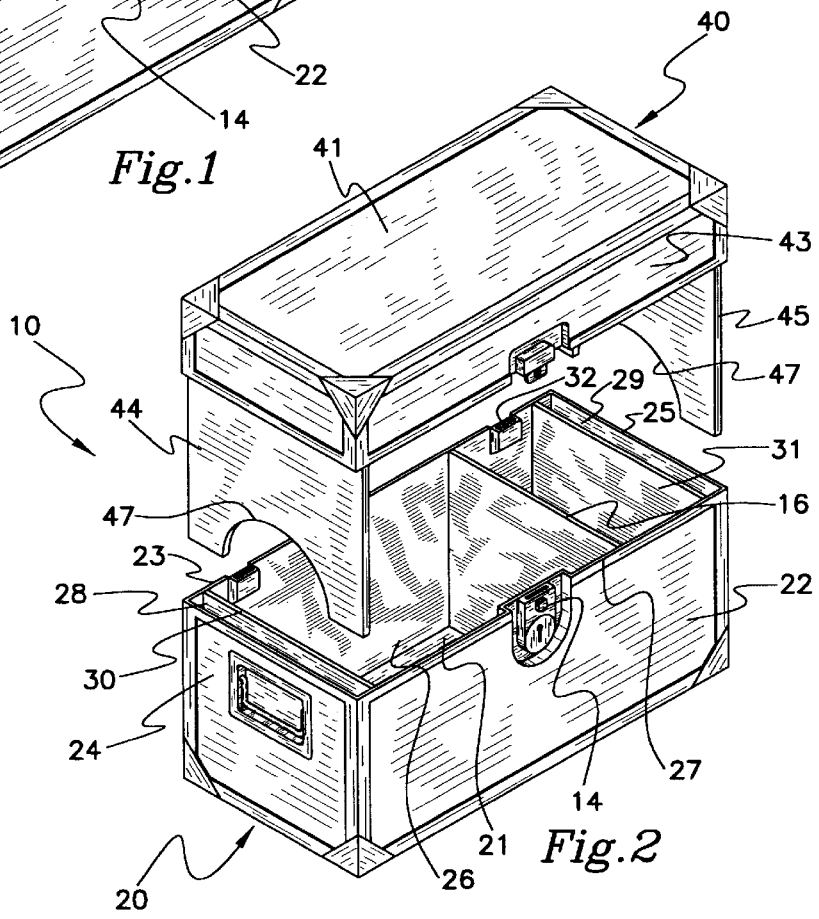
FIG. 2 is a schematic perspective view of the present invention not in the assembled condition showing the legs extending from the top lid.

With reference now to the drawings, and in particular to FIGS. 1 through 4 thereof, a new combination box and stool embodying the principles and concepts of the present invention and generally designated by the reference numeral 10 will be described.

Figure 3:
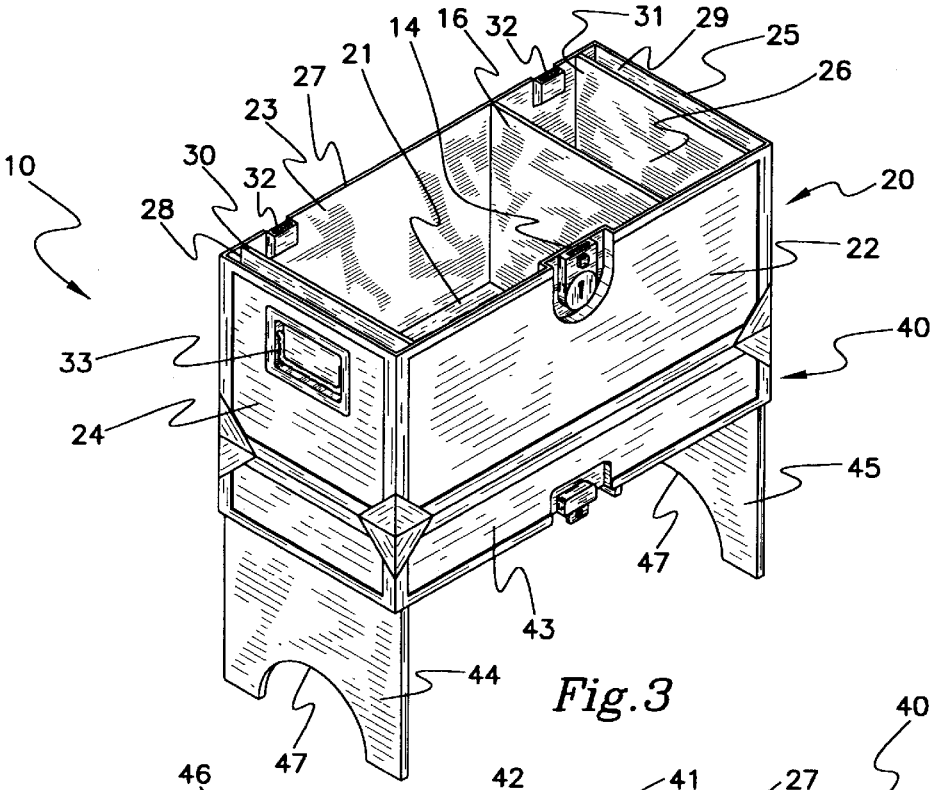
FIG. 3 is a schematic perspective view of the present invention with the bottom container resting on the top lid.

As best illustrated in FIGS. 1 through 4, the combination box and stool 10 generally comprises a bottom container 20 with front 22, back 23, and side walls 24,25 upwardly extending from a bottom wall 21 to define a bottom container hollow interior 26. When the invention 10 is in an assembled condition 12 a top lid 40 rests on the bottom container top edge 27 to cover the bottom container hollow interior 26. The top lid 40 has a pair of spaced apart legs 44,45 downwardly extending from the top lid lower surface 42. When in the assembled condition 12, each leg 44,45 is inserted into a respective leg slot 28,29 defined by each of the side walls 24,25. A locking means 14 is included for locking the top lid 40 to the bottom container 20 when positioned in the assembled condition 12. When the top lid 40 and the bottom container 20 are not in the assembled condition, as shown in FIG. 3, the legs 44,45 are restable on a surface and the bottom container bottom wall 21 is restable on the top lid upper surface 41.

Preferably, the combination box and stool 10 also includes a first slot panel 30 and a second slot panel 31. The slot panels 30,31 are both extended from the bottom wall 21 between the front and back walls 22,23. The first slot panel 30 is spaced apart from one of the side walls 24 to define the first leg slot 28 between them while the second slot panel 31 is spaced apart from the other side wall 25 to define the second leg slot 29 between them.

In the preferred embodiment, the invention further includes a divider panel 16 extending from the bottom wall 21 between the front and back walls 22,23 so that the divider panel 16 is positioned between the side walls 24,25.

Figure 4:
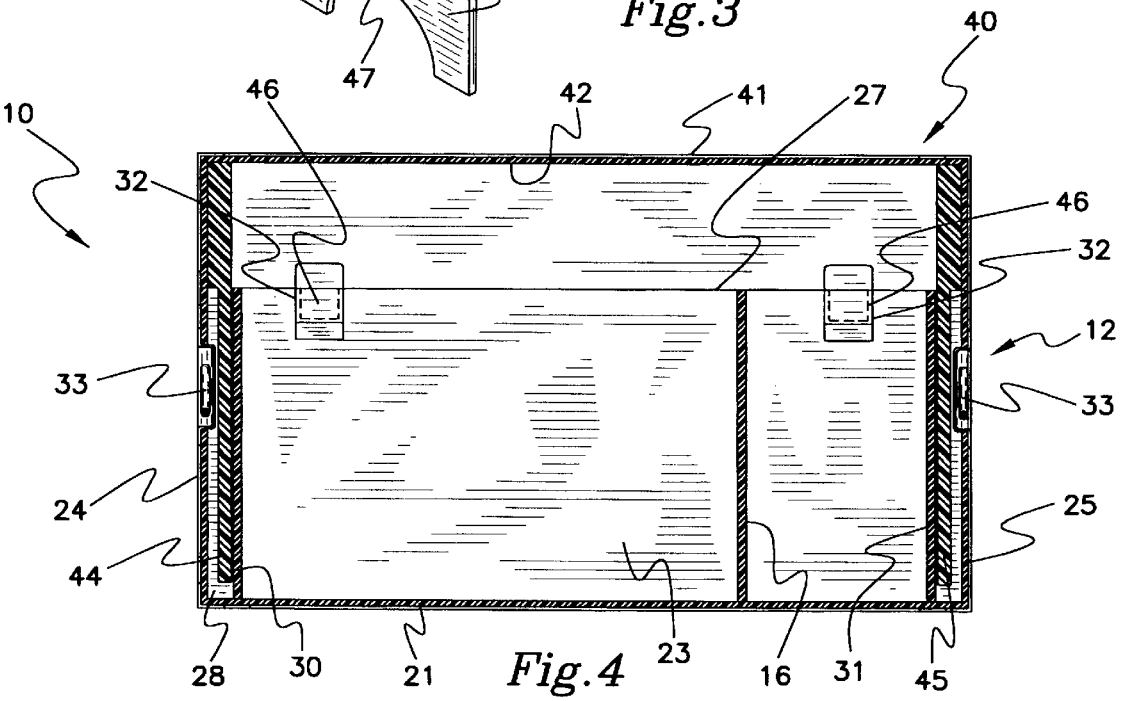
FIG. 4 is a schematic cross sectional view of the present invention in the assemble condition.

With reference to FIG. 4, the back wall includes a plurality of tab slots 32 each being downwardly extended from the top edge of the back wall 23. Correspondingly, the top lid 40 has a pair of attachment tabs 46 downwardly extending therefrom so that when the invention is in the assembled condition 12 the attachment tabs 46 are inserted into the tab slots 32.

Preferably, the top lid 40 also includes an outer skirt wall 43 that downwardly extends around the outer perimeter of the top lid lower surface 42 with the attachment tabs downwardly extended from the top lid outer skirt wall 43.

As shown in the Figures, it is preferable that the bottom 21, front 22, back 23 and side walls 24,25 of the bottom container 20 as well as the slot panels 30,31 and the divider panel 16 are substantially planar and rectangular. Similarly, the top lid upper and lower surfaces 41,42 are also preferably substantially planar and rectangular.

In the preferred embodiment each of the bottom container side wall includes a handle 33 for aiding carrying of the combination box and stool 10.

Ideally, each of the legs 44,45 is substantially planar with each bottom edge of the legs 44,45 having a cutout 47 that may be used to help lift and position the top lid 40. The legs 44,45 are restable on a surface when the top lid is not in the assembled condition to permit sitting on the top lid 40 or resting of the bottom container 20 thereon.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A storage container, comprising:

a bottom container having a bottom wall, spaced apart front and back walls, and a pair of spaced apart side walls, said front and back walls being upwardly extended from said bottom wall, said side walls being upwardly extended from said bottom wall between said front and back walls, said front, back and side walls defining bottom container hollow interior, each said front, back and side wall having a top edge, said top edges of said front, back and side walls defining a bottom container top edge;

wherein one of said side walls defines a first leg slot;

wherein the other said side wall defines a second leg slot;

a top lid having upper and lower surfaces, said top lid upper surface being for permitting resting of an object thereon;

a pair of spaced apart legs being downwardly extended from said top lid lower surface;

said top lid and said bottom container being positionable in an assembled condition, wherein said assembled condition is characterized by said top lid being rested on said bottom container top edge such that said bottom container hollow interior is covered by said top lid, one said leg being inserted into said first leg slot, and the other said leg being inserted into said second leg slot;

locking means for locking said top lid to said bottom container when said top lid and said bottom container are positioned in said assembled condition; and wherein said legs are restable on a surface and said bottom container bottom wall is restable on said top lid upper surface when said top lid and said bottom container are not in said assembled condition.

2. The storage container of claim 1, further comprising a first slot panel and a second slot panel, said first slot panel being extended from said bottom wall between said front and back walls, second slot panel being extended from said bottom wall between said front and back walls, wherein said first slot panel is spaced apart from one of said side walls to define said first leg slot therebetween, and wherein said second slot panel is spaced apart from other of said side walls to define said second leg slot therebetween.

3. The storage container of claim 1, further comprising a divider panel being extended from said bottom wall between said front and back walls, said divider panel being positioned between said pair of side walls.

4. The storage container of claim 1, wherein said back wall has a plurality of tab slots being downwardly extended from said top edge of said back wall, wherein said top lid has a pair of attachment tabs being downwardly extended therefrom, and wherein said assembled condition is further characterized by said attachment tabs being inserted into said tab slots.

5. The storage container of claim 4, wherein said top lid has an outer skirt wall being downwardly extended around the outer perimeter of said top lid lower surface, wherein said attachment tabs are downwardly extended from said top lid outer skirt wall.

6. The storage container of claim 1, wherein each said bottom container side wall has a handle.

7. The storage container of claim 1, wherein said front, back and side walls of said bottom container are substantially planar and rectangular, and wherein said top lid upper and lower surfaces are having substantially planar and rectangular.

8. The storage container of claim 1, wherein each said leg has a bottom edge from resting on a surface, each said leg bottom edge having a cutout.

9. A storage container, comprising:

a bottom container having a substantially planar rectangular bottom wall, spaced apart substantially planar rectangular front and back walls, and a pair of spaced apart substantially planar rectangular side walls, said front and back walls being upwardly extended from said bottom wall, said side walls being upwardly extended from said bottom wall between said front and back walls, said front, back and side walls defining bottom container hollow interior, each said front, back and side wall having a top edge, said top edges of said front, back and side walls defining a bottom container top edge;

each said bottom container side wall having a handle;

a substantially planar rectangular first slot panel being extended from said bottom wall between said front and back walls, said first slot panel being spaced apart from one of said side walls to define a first leg slot therebetween;

a substantially planar rectangular second slot panel being extended from said bottom wall between said front and back walls, said second slot panel being spaced apart from another of said side walls to define a second leg slot therebetween;

a substantially planar rectangular divider panel being extended from said bottom wall between said front and back walls, said divider panel being positioned between said pair of side walls;

said back wall having a plurality of tab slots being downwardly extended from said top edge of said back wall;

a top lid having substantially planar rectangular upper and lower surfaces, and an outer skirt wall being downwardly extended around the outer perimeter of said top lid lower surface, said top lid upper surface being for permitting resting of an object thereon;

said top lid outer skirt wall having a pair of attachment tabs being downwardly extended therefrom;

a pair of spaced apart substantially planar legs being downwardly extended from said top lid lower surface, each said leg having a bottom edge from resting on a surface, each said leg bottom edge having a cutout;

said top lid and said bottom container being positionable in an assembled condition, wherein said assembled condition is characterized by said top lid outer skirt wall being rested on said bottom container top edge such that said bottom container hollow interior is covered by said top lid, said attachment tabs being inserted into said tab slots, one said leg being inserted into said first leg slot, and the other said leg being inserted into said second leg slot;

locking means for locking said top lid to said bottom container when said top lid and said bottom container are positioned in said assembled condition; and wherein said legs are restable on a surface and said bottom container bottom wall is restable on said top lid upper surface when said top lid and said bottom container are not in said assembled condition.

* * * * *